US011486213B2

(12) United States Patent
Kelly, III et al.

(10) Patent No.: US 11,486,213 B2
(45) Date of Patent: Nov. 1, 2022

(54) METHOD AND APPARATUS FOR GAINING REENTRY BELOW ABANDONED WELLBORE EQUIPMENT

(71) Applicant: Saudi Arabian Oil Company, Dhahran (SA)

(72) Inventors: Benton Kelly, III, Dhahran (SA); Ahmed Al-Ramadhan, Dhahran (SA); Ahmed Al-Mousa, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 23 days.

(21) Appl. No.: 17/135,244

(22) Filed: Dec. 28, 2020

(65) Prior Publication Data

US 2022/0205329 A1 Jun. 30, 2022

(51) Int. Cl.

| | |
|---|---|
| ***E21B 23/00*** | (2006.01) |
| ***E21B 17/042*** | (2006.01) |
| ***E21B 17/10*** | (2006.01) |

(52) U.S. Cl.

CPC ..... *E21B 23/004* (2013.01); *E21B 17/042* (2013.01); *E21B 17/1078* (2013.01)

(58) Field of Classification Search

CPC ..... E21B 31/18; E21B 23/004; E21B 17/042; E21B 17/1078

See application file for complete search history.

(56) References Cited

U.S. PATENT DOCUMENTS

| | | | | |
|---|---|---|---|---|
| 2,295,630 | A * | 9/1942 | Bowen | E21B 31/18 294/86.17 |
| 3,727,967 | A | 4/1973 | Anastasiu et al. | |
| 3,788,396 | A | 1/1974 | Shatto et al. | |
| 3,954,137 | A | 5/1976 | Baugh | |
| 4,705,111 | A * | 11/1987 | Bourg | E21B 33/12 166/380 |
| 7,562,714 | B2 | 7/2009 | Lynde | |
| 7,600,571 | B2 | 10/2009 | Smith | |
| 7,617,867 | B2 | 11/2009 | Lynde et al. | |
| 8,607,879 | B2 | 12/2013 | Reynolds | |
| 8,657,530 | B2 | 2/2014 | Anderson et al. | |
| 2004/0262005 | A1 | 12/2004 | Harmon et al. | |

(Continued)

FOREIGN PATENT DOCUMENTS

| | | |
|---|---|---|
| GB | 2341653 A | 3/2022 |
| WO | 2011060423 A1 | 5/2011 |

OTHER PUBLICATIONS

G. L. Holloway, "Diamond Coring System—Seafloor Component Hardware", Proceedings of the Ocean Drilling Program, Initial Reports, 1991, vol. 132, pp. 163-210.

(Continued)

*Primary Examiner* — Kristyn A Hall

(74) *Attorney, Agent, or Firm* — Bracewell LLP; Constance G. Rhebergen; Linda L. Morgan

(57) ABSTRACT

Systems and methods for accessing a wellbore of a subterranean well downhole of abandoned subterranean wellbore equipment include a re-entry guide secured to an uphole end of an overshot. The re-entry guide and overshot together form a re-entry tool. The overshot has an inner diameter gripping assembly sized to grip a tubing stub. The re-entry guide has an outer diameter sized to match a drift inner diameter of a casing of the subterranean well.

18 Claims, 3 Drawing Sheets

(56) References Cited

U.S. PATENT DOCUMENTS

| | | | | |
|---|---|---|---|---|
| 2005/0150659 | A1* | 7/2005 | Popilian | E21B 43/10 166/212 |
| 2008/0202748 | A1* | 8/2008 | Bussear | E21B 43/128 166/264 |

OTHER PUBLICATIONS

International Search Report and Written Opinion for PCT Application No. PCT/US2021/065186 dated Mar. 25, 2022.

* cited by examiner

METHOD AND APPARATUS FOR GAINING REENTRY BELOW ABANDONED WELLBORE EQUIPMENT

BACKGROUND OF THE DISCLOSURE

1. Field of the Disclosure

The disclosure relates generally to the operation of a subterranean well, and more particularly to accessing a bore of a subterranean well downhole of abandoned subterranean wellbore equipment.

2. Description of the Related Art

There are circumstances when equipment in a subterranean well is abandoned or orphaned. A tubular member extending through such equipment can be cut uphole of the equipment and retrieved from the subterranean well. This leaves an uphole facing tubing stub behind within the wellbore. There may be times when an operator desires to access the wellbore downhole of the orphaned equipment by passing a well member through the tubing stub.

SUMMARY OF THE DISCLOSURE

Embodiments of this disclosure include a re-entry tool that can be delivered into a casing of subterranean well and attached to a tubing stub uphole of orphaned equipment. The re-entry tool can provide a smooth transition from the inner diameter of the casing to the inner diameter of the tubing sub, allowing for easy access to the wellbore downhole of the orphaned equipment for well members that are later lowered through the casing.

The re-entry tool can include a re-entry guide and an overshot, with the re-entry guide secured to an uphole end of the overshot. The re-entry tool will have a deployment latch that allows the re-entry tool to be releasably secured to an installation string so that the re-entry tool can be delivered into the wellbore riglessly. The overshot can secure the re-entry tool to the tubing stub. An intervention by a well member such as by coil tubing, e-line, or slick line will be able to access the wellbore downhole of the orphaned packer by way of the re-entry tool.

In an embodiment of this disclosure, a system for accessing a wellbore of a subterranean well downhole of abandoned subterranean wellbore equipment has a re-entry guide secured to an uphole end of an overshot. The re-entry guide and overshot together form a re-entry tool. The overshot has an inner diameter gripping assembly sized to grip a tubing stub. The re-entry guide has an outer diameter sized to match a drift inner diameter of a casing of the subterranean well.

In alternate embodiments, the re-entry guide can include a deployment latch. The deployment latch can be operable to releasably secure the re-entry tool to an installation string. The installation string can be a coiled tubing. The deployment latch can be a J-latch profile. The overshot can have an uphole facing threaded box connector at the uphole end of the overshot. The re-entry guide can have a downhole facing threaded pin connector at a downhole end of the re-entry guide.

In other alternate embodiments, the system can further include a guide nipple extending radially inward from an inner diameter surface of the re-entry tool. The guide nipple can be a ring shaped member positionable uphole of an uphole end of the tubing stub. The inner diameter gripping assembly of the overshot can be a grapple. The re-entry guide can have an upward facing frusto-conical inner diameter surface. The upward facing frusto-conical inner diameter surface can be at an angle in a range of 12 to 17 degrees relative to a central axis of the re-entry guide.

In an alternate embodiment of this disclosure, a method for accessing a wellbore of a subterranean well downhole of abandoned subterranean wellbore equipment includes securing a re-entry guide to an uphole end of an overshot. The re-entry guide and overshot together form a re-entry tool. An inner diameter gripping assembly of the overshot is sized to grip a tubing stub. An outer diameter of the re-entry guide is sized to match a drift inner diameter of a casing of the subterranean well.

In alternate embodiments, the re-entry guide can include a deployment latch and the method can further include releasably securing the re-entry tool to an installation string with the deployment latch. The installation string can be a coiled tubing and the method can further include lowering the re-entry tool into the casing with the coiled tubing. The deployment latch can be a J-latch profile and the method can further include releasably securing the installation string to the J-latch profile of the re-entry tool, lowering the re-entry tool into the casing with the installation string, and releasing the installation string from the J-latch profile.

In other alternate embodiments, the overshot can have an uphole facing threaded box connector at the uphole end of the overshot and the re-entry guide can have a downhole facing threaded pin connector at a downhole end of the re-entry guide. The method can further include securing the re-entry guide to the uphole end of the overshot by threading the pin connector of the re-entry guide into the box connector of the overshot. The method can alternately further including lowering the overshot over the tubing stub and gripping the tubing stub with the inner diameter gripping assembly of the overshot. The inner diameter gripping assembly of the overshot can be a grapple, and the method can include gripping the tubing stub with the grapple.

In yet other alternate embodiments, a guide nipple can extend radially inward from an inner diameter surface of the re-entry tool, the guide nipple being a ring shaped member. The method can further include positioning the guide nipple uphole of an uphole end of the tubing stub. The method can alternately further include guiding a well member through the re-entry tool and into the tubing stub with the guide nipple. The re-entry guide can have an upward facing frusto-conical inner diameter surface, where the upward facing frusto-conical inner diameter surface is at an angle in a range of 12 to 17 degrees relative to a central axis of the re-entry guide. The method can further include directing a well member into the re-entry tool with the upward facing frusto-conical inner diameter surface.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
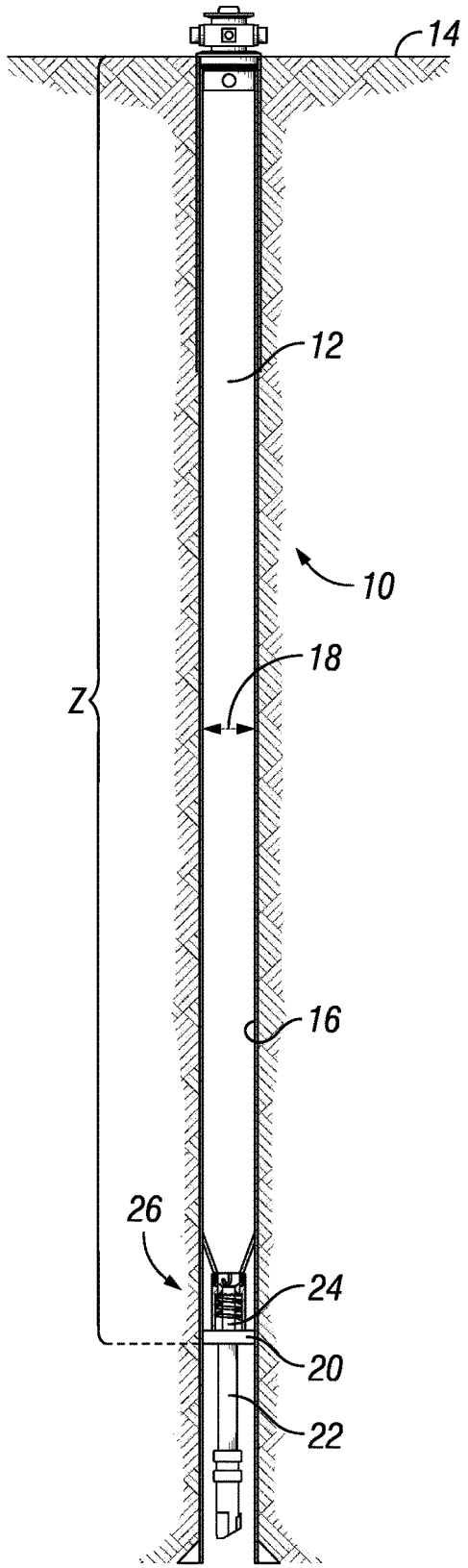
FIG. 1 is a schematic section view of a subterranean well with a re-entry tool, in accordance with an embodiment of this disclosure.

Looking at FIG. 1, subterranean well 10 can have wellbore 12 that extends to an earth's surface 14. Subterranean well 10 can be an offshore well or a land based well and can be a well associated with hydrocarbon development operations, such as, for example, a hydrocarbon production well, an injection well, or a water well. Wellbore 12 can be drilled from surface 14 and into and through various subterranean formations. In the example of FIG. 1, wellbore 12 extends generally vertically relative to the earth's surface 14. In alternate embodiments, at least a portion of wellbore 12 can be a horizontal well that extends generally horizontally relative to the earth's surface 14, or can be an inclined well that extends at another angle relative to earth's surface 14.

Casing 16 can line an inner diameter surface of wellbore 12. Casing 16 can be formed of a series of tubular pipe joints that are secured end to end. Casing 16 can be a tubular member that has a bore with a nominal inner diameter. Because the nominal inner diameter is not a guaranteed diameter and can vary over the length of casing 16, casing 16 also has a drift inner diameter 18. Drift inner diameter 18 of casing 16 is a smaller measurement than the nominal inner diameter. As an example, drift inner diameter 18 can be 3.2 mm smaller than the nominal inner diameter. Drift inner diameter 18 is the inside diameter of casing 16 that is guaranteed by the pipe manufacturer and can be used to determine what size of tools can be run through the tubular member.

During well workover operations, it may become necessary or desirable to abandon or orphan a piece of equipment 20 within the bore of casing 16. Equipment 20 can be, for example, a packer as shown in FIG. 1. In alternate embodiments, equipment 20 can be, for example, a polished bore receptacle, a screen assembly, a test tool that has been inadvertently cemented in place, or stuck coil tubing. Equipment 20 can be located a distance Z from surface 14. Distance Z can be in a range, for example, of 100 feet to the total depth of the wellbore.

When orphaning equipment 20, tubing 22 can be cut uphole of equipment 20, leaving tubing stub 24. Tubing 22 can be, for example, a production tubing that delivers hydrocarbons from below equipment 20 to the surface 14. Alternately, tubing 22 can be an injection tubular, coil tubing, or drill pipe. Tubing stub 24 is an upward facing portion of tubing 22. Tubing stub 24 can be cut in a way that tubing stub 24 has an uneven or irregular cut end.

With tubing stub 24 extending upward above orphaned equipment 20, aligning a well member with tubing stub 24 in order to pass the well member through tubing stub 24, past equipment 20, and into the wellbore downhole of equipment 20 can be challenging. Re-entry tool 26 can be used to facilitate the passage of the well member through tubing stub 24, past equipment 20, and into the wellbore downhole of equipment 20.

Figure 2:
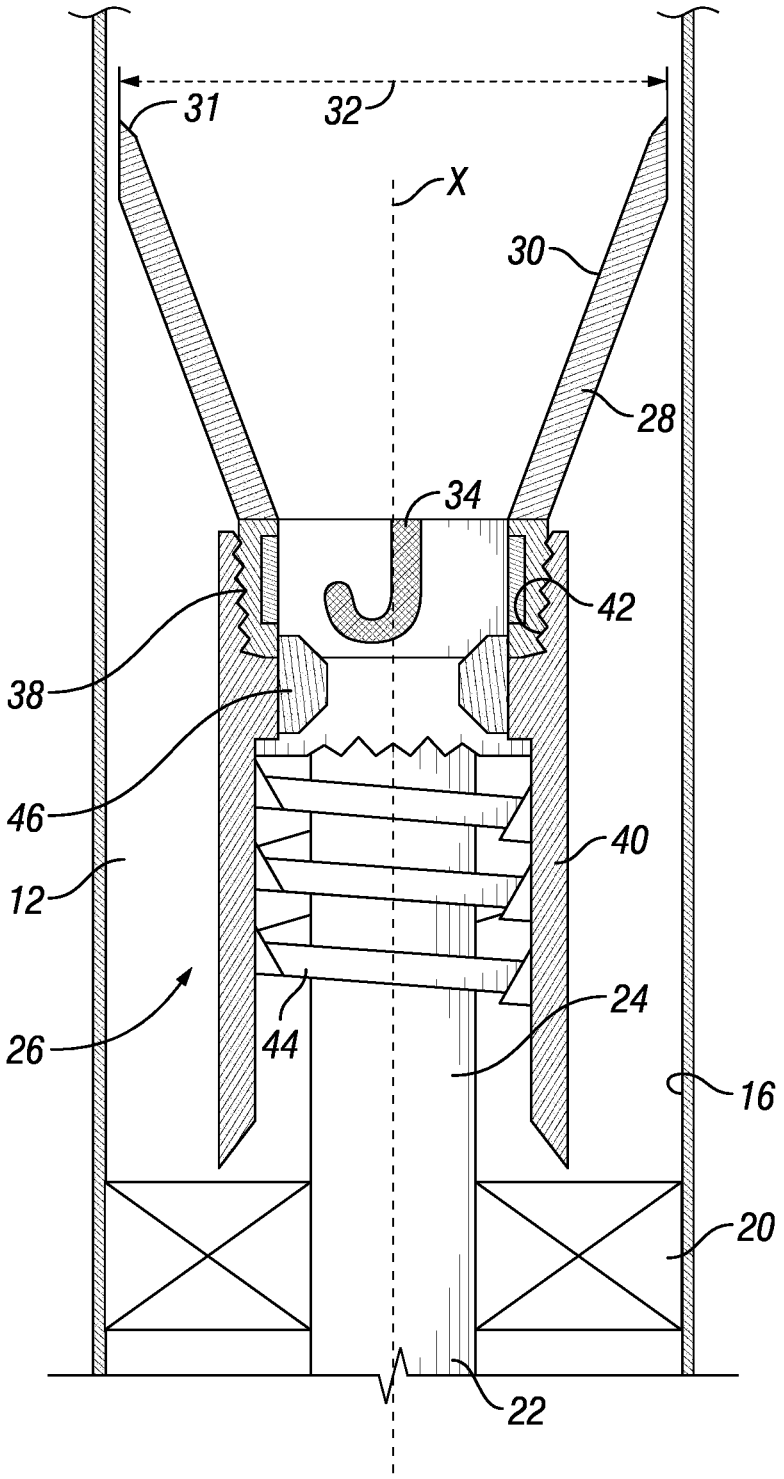
FIG. 2 is a schematic detail view of a re-entry tool located within casing of a subterranean well, in accordance with an embodiment of this disclosure.

Looking at FIG. 2, re-entry tool 26 includes re-entry guide 28. Re-entry guide 28 has an upward facing frusto-conical inner diameter surface 30. Frusto-conical inner diameter surface 30 is upward facing with a narrower at a downhole end and larger at an uphole end. Frusto-conical inner diameter surface 30 can be at an angle in a range of 12 to 17 degrees relative to a central axis X of re-entry guide 28. In an alternate embodiment, frusto-conical inner diameter surface 30 can be at an angle of 15 degrees relative to a central axis X of re-entry guide 28. Re-entry tool 26 can further include lead in lip 31 that is located at an uphole end of inner diameter surface 30. Lead in lip 31 can be at an angle in a range of 25 to 35 degrees relative to central axis X. In an alternate embodiment, lead in lip 31 can be at an angle of 30 degrees relative to a central axis X.

Re-entry guide 28 has an outer diameter 32 that matches drift inner diameter 18 of casing 16 (FIG. 1). With re-entry guide 28 having the largest outer diameter possible to run into casing 16, a well member delivered into casing 16 will enter re-entry guide 28 regardless of where the well member is positioned radially within casing 16. The well member is not required to be delivered along central axis X to enter re-entry guide 28.

In order to deliver re-entry tool 26 into casing 16, re-entry guide 28 includes deployment latch 34. Looking at FIGS.

3-4, deployment latch 34 can be used to releasably secure re-entry tool 26 to installation string 36. In the example embodiments shown, deployment latch 34 is a J-latch profile. In alternate embodiments, deployment latch 34 can be a latch that is adapted to be secured to a hydraulic running tool on coil tubing or on drill pipe. Installation string 36 can be, for example, coiled tubing so that re-entry tool 26 can be riglessly installed. In alternate embodiments, installation string 36 can be a pipe string.

Looking at FIG. 2, re-entry guide 28 can further include downhole connector 38. Downhole connector 38 is located at a downhole end of re-entry guide 28. In the example embodiment of FIG. 2, downhole connector 38 is a downhole facing threaded pin connector. In alternate embodiments, downhole connector 38 can be a welded connection or re-entry guide 28 can be integrally formed with overshot 40.

Re-entry tool 26 can further include overshot 40. Re-entry guide 28 and overshot 40 together form re-entry tool 26. Overshot 40 has uphole connector 42. Uphole connector 42 can be used to secure overshot 40 to re-entry guide 28. Uphole connector 42 can be located at the uphole end of overshot 40. In the example embodiment of FIG. 2, uphole connector 42 is an uphole facing threaded box connector. In such an embodiment downhole connector 38 can be threaded into uphole connector 42 to secure re-entry guide 28 to overshot 40. In alternate embodiments, uphole connector 42 can be a welded connection or re-entry guide 28 can be integrally formed with overshot 40.

Overshot 40 has inner diameter gripping assembly 44. Gripping assembly 44 is sized to grip tubing stub 24. Gripping assembly 44 can be, for example, a grapple, such as a basket or spiral grapple. In the example embodiment of FIG. 2, the gripping assembly is a spiral grapple. Gripping assembly 44 can be used to secure re-entry tool 26 to tubing stub 24.

Re-entry tool 26 can further include guide nipple 46. Guide nipple 46 extends radially inward from an inner diameter surface of re-entry tool 26. Guide nipple 46 is a generally ring shaped member that reduces the inner diameter of re-entry tool 26. Guide nipple 46 is located within re-entry tool 26 so that guide nipple 46 is positioned uphole of an uphole end of tubing stub 24 when re-entry tool 26 is secured to tubing stub 24. In the example embodiment of FIG. 2, guide nipple 46 is secured to or part of overshot 40. In alternate embodiments, guide nipple 46 is secured to or part of re-entry guide 28.

Guide nipple 46 can have an inner diameter that is equivalent to or less than the inner diameter of tubing 22. Guide nipple 46 can be used to direct a well member that has entered re-entry guide 28 into tubing stub 24.

Figure 3:
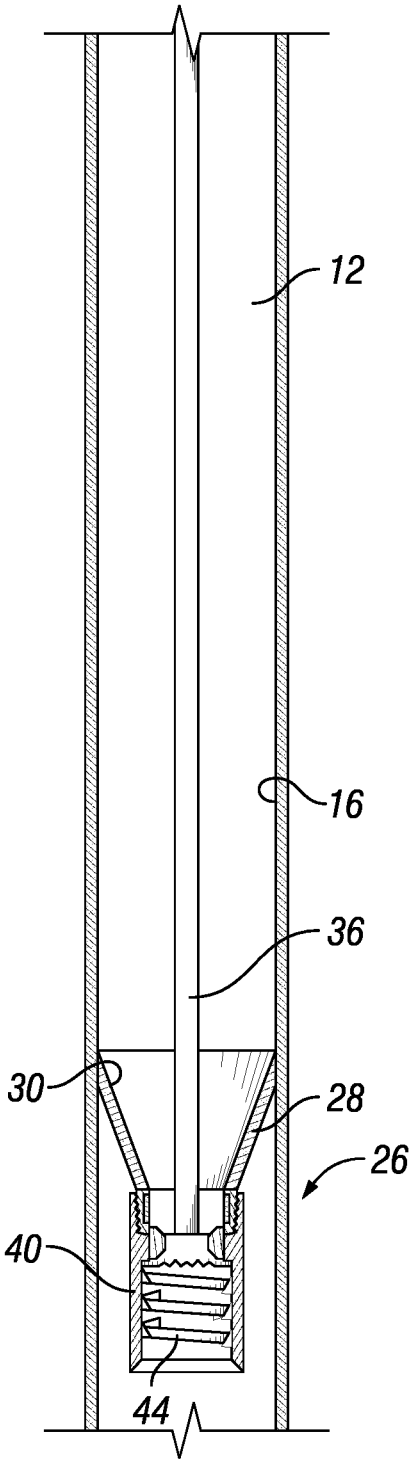
FIG. 3 is a schematic detail view of a re-entry tool being delivered into a subterranean well with an installation string, in accordance with an embodiment of this disclosure.

Looking at FIGS. 1-3, in an example of operation, in order to access wellbore 12 downhole of orphaned equipment 20, a re-entry tool 26 can be selected that is sized with an outer diameter of the re-entry guide 28 that matches the drift inner diameter 18 of casing 16, and that is sized with an inner diameter gripping assembly 44 of overshot 40 to grip tubing stub 24. Re-entry tool 26 can be provided immediately after orphaning equipment 20 in anticipation of a future need to access wellbore 12 downhole of orphaned equipment 20. Alternately, re-entry tool 26 can be provided only when need at some point in the future after the orphaning of equipment 20.

Re-entry tool 26 can be releasably secured to installation string 36 by way of deployment latch 34. Re-entry tool 26 can be lowered into casing 16 with installation string 36. In certain embodiments, the installation of re-entry tool 26 can be rigless, such as when installation string 36 is coiled tubing. Overshot 40 of re-entry tool 26 can be lowered over tubing stub 24 and inner diameter gripping assembly of overshot 40 can be used to secure re-entry tool 26 to tubing stub 24. Installation string 36 can be released from re-entry tool 26 so that installation string 36 can be returned to the surface.

Figure 4:
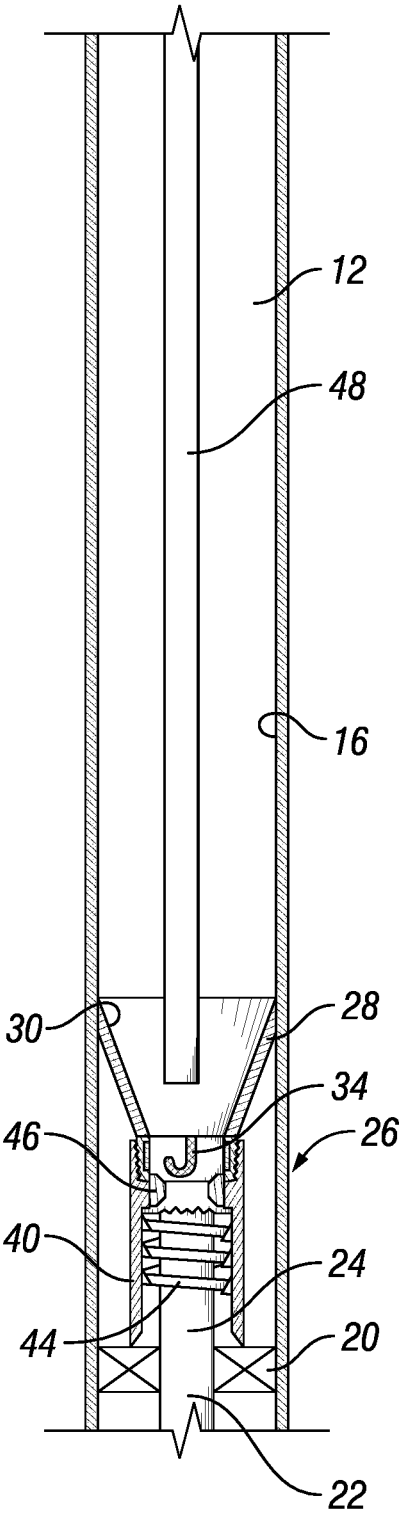
FIG. 4 is a schematic detail view of a well member entering a re-entry tool of a subterranean well, in accordance with an embodiment of this disclosure.

Looking at FIG. 4, as an operator lowers well member 48 into casing 16, regardless of whether or not well member 48 is offset from a centerline of casing 16 or re-entry tool 26, well member 48 will be guided by re-entry guide 28 into re-entry tool 26. Well member 48 can be, for example, part of a rigless intervention that includes a coil tubing, an e-line, or a slick line, or part of an intervention with a rig. As an example, well member 48 can be e-line cased hole logging tools, slickline downhole pressure gages, clean out buts, acidizing or stimulation treatment tools, through tubing intervention tools, or thru tubing bridge plugs. As well member 48 passes through re-entry tool 26, well member 48 will be guided into tubing stub 24 with guide nipple 46.

Embodiments of this disclosure therefore provide systems and methods for accessing a wellbore downhole of orphaned equipment. The tubing through the equipment can be cut and removed uphole of the equipment and the equipment can be abandoned within the wellbore. Fishing or milling equipment from within a casing is costly, risky, and time consuming. Systems and methods of this disclosure eliminate the need to fish or mill the equipment out of the subterranean well by providing the re-entry tool for wellbore access downhole of the tubing stub.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for accessing a wellbore of a subterranean well downhole of abandoned subterranean wellbore equipment, the system having:

a re-entry guide secured to an uphole end of an overshot, the re-entry guide and overshot together forming a re-entry tool; where the overshot has an inner diameter gripping assembly sized to grip a tubing stub;

the re-entry guide has an outer diameter sized to match a drift inner diameter of a casing of the subterranean well; and the re-entry guide has an upward facing frusto-conical inner diameter surface.

2. The system of claim 1, where the re-entry guide includes a deployment latch, the deployment latch operable to releasably secure the re-entry tool to an installation string.

3. The system of claim 2, where the installation string is a coiled tubing.

4. The system of claim 2, where the deployment latch is a J-latch profile.

5. The system of claim 1, where the overshot has an uphole facing threaded box connector at the uphole end of the overshot.

6. The system of claim 1, where the re-entry guide has a downhole facing threaded pin connector at a downhole end of the re-entry guide.

7. The system of claim 1, further including a guide nipple extending radially inward from an inner diameter surface of the re-entry tool, the guide nipple being a ring shaped member positionable uphole of an uphole end of the tubing stub.

8. The system of claim 1, where the inner diameter gripping assembly of the overshot is a grapple.

9. The system of claim 1, where the upward facing frusto-conical inner diameter surface is at an angle in a range of 12 to 17 degrees relative to a central axis of the re-entry guide.

10. A method for accessing a wellbore of a subterranean well downhole of abandoned subterranean welbore equipment, the method including:

securing a re-entry guide to an uphole end of an overshot, where the re-entry guide and overshot together forming a re-entry tool;

sizing an inner diameter gripping assembly of the overshot to grip a tubing stub;

sizing an outer diameter of the re-entry guide to match a drift inner diameter of a casing of the subterranean well;

positioning a guide nipple uphole of an uphole end of the tubing stub, the guide nipple extending radially inward from an inner diameter surface of the re-entry tool, and the guide nipple being a ring shaped member; and guiding a well member through the re-entry tool and into the tubing stub with the guide nipple.

11. The method of claim 10, where the re-entry guide includes a deployment latch, the method further including releasably securing the re-entry tool to an installation string with the deployment latch.

12. The method of claim 11, where the installation string is a coiled tubing, the method further including lowering the re-entry tool into the casing with the coiled tubing.

13. The method of claim 11, where the deployment latch is a J-latch profile, the method further including releasably securing the installation string to the J-latch profile of the re-entry tool, lowering the re-entry tool into the casing with the installation string, and releasing the installation string from the J-latch profile.

14. The method of claim 10, where the overshot has an uphole facing threaded box connector at the uphole end of the overshot and where the re-entry guide has a downhole facing threaded pin connector at a downhole end of the re-entry guide, the method further including securing the re-entry guide to the uphole end of the overshot by threading the pin connector of the re-entry guide into the box connector of the overshot.

15. The method of claim 10, further including lowering the overshot over the tubing stub and gripping the tubing stub with the inner diameter gripping assembly of the overshot.

16. The method of claim 10, where the inner diameter gripping assembly of the overshot is a grapple, the method including gripping the tubing stub with the grapple.

17. The method of claim 10, where the re-entry guide has an upward facing frusto-conical inner diameter surface, where the upward facing frusto-conical inner diameter surface is at an angle in a range of 12 to 17 degrees relative to a central axis of the re-entry guide, the method further including directing a well member into the re-entry tool with the upward facing frusto-conical inner diameter surface.

18. A method for accessing a wellbore of a subterranean well downhole of abandoned subterranean welbore equipment, the method including:

securing a re-entry guide to an uphole end of an overshot, where the re-entry guide has an upward facing frusto-conical inner diameter surface, where the upward facing frusto-conical inner diameter surface is at an angle in a range of 12 to 17 degrees relative to a central axis of the re-entry guide, the re-entry guide and overshot together forming a re-entry tool;

sizing an inner diameter gripping assembly of the overshot to grip a tubing stub;

sizing an outer diameter of the re-entry guide to match a drift inner diameter of a casing of the subterranean well; and directing a well member into the re-entry tool with the upward facing frusto-conical inner diameter surface.

* * * * *